US011293188B2

(12) United States Patent
Henry et al.

(10) Patent No.: US 11,293,188 B2
(45) Date of Patent: Apr. 5, 2022

(54) ARCHITECTURAL WALL PANEL SYSTEM

(71) Applicant: C.E.I. Composite Materials, LLC, Manchester, MI (US)

(72) Inventors: Jeffrey L. Henry, Manitou Beach, MI (US); Jason J. Sherrill, Ann Arbor, MI (US)

(73) Assignee: C.E.I. Composite Materials, Inc., Manchester, MI (US)

( * ) Notice: Subject to any disclaimer, the term of this patent is extended or adjusted under 35 U.S.C. 154(b) by 0 days.

(21) Appl. No.: 16/733,710

(22) Filed: Jan. 3, 2020

(65) Prior Publication Data

US 2021/0207383 A1 Jul. 8, 2021

(51) Int. Cl.
*E04F 13/08* (2006.01)
*E04F 13/00* (2006.01)

(52) U.S. Cl.
CPC ..... *E04F 13/0894* (2013.01); *E04F 13/0833* (2013.01); *E04F 13/0848* (2013.01)

(58) Field of Classification Search
CPC ..... E04F 13/0833; E04F 13/0857; E04F 13/0894
USPC ..... 52/588.1
See application file for complete search history.

(56) References Cited

U.S. PATENT DOCUMENTS 1,062,563 A * 5/1913 Brogden et al. ..... A47B 21/06 52/588.1
1,582,611 A * 4/1926 Kane ..... E04B 1/08 52/588.1
2,019,379 A * 10/1935 Anderson ..... E06B 9/15 160/235
2,642,968 A * 6/1953 Roush ..... E04F 13/0803 52/520
3,535,844 A * 10/1970 Emanuel ..... E04F 13/12 52/592.1
3,710,525 A * 1/1973 Lopes ..... E04B 1/34342 52/169.12
3,885,362 A * 5/1975 Pollock ..... E04H 1/1238 52/126.7
3,887,410 A * 6/1975 Lindner ..... B32B 27/065 156/79
4,107,892 A * 8/1978 Bellem ..... E04B 1/54 52/396.04

(Continued)

FOREIGN PATENT DOCUMENTS

EP 3192933 A1 * 7/2017 ..... E04F 13/0805
KR 100471664 B1 * 3/2005 ..... E04F 13/0805

*Primary Examiner* — Brian D Mattei
*Assistant Examiner* — Joseph J. Sadlon
(74) *Attorney, Agent, or Firm* — Eric J. Sosenko; Jonathan P. O'Brien; Honigman LLP

(57) ABSTRACT

An architectural wall panel comprising a panel body including a generally rectangular face plate having an upper end and a lower end. An upper flange generally extends in a rearward direction the upper end and includes a first projection projecting laterally relative to the rearward direction. A lower flange generally extends in a rearward direction from the lower end of the face plate and terminates in a clip. The clip includes a first portion extending toward the upper flange and a second portion extending away from the upper flange and is configured to clamp therebetween a first projection of a second architectural wall panel positioned below the architectural wall panel.

18 Claims, 4 Drawing Sheets

(56) References Cited

U.S. PATENT DOCUMENTS 4,122,643 A * 10/1978 Hafner ..... E04F 13/0864 52/520
4,267,679 A * 5/1981 Thompson ..... E04C 2/292 52/478
4,283,897 A * 8/1981 Thompson ..... E04B 1/80 52/478
4,599,840 A * 7/1986 Ingvarsson ..... E04B 5/40 52/319
4,700,520 A * 10/1987 Ting ..... E04C 2/292 52/478
4,715,157 A * 12/1987 Funaki ..... E04D 3/30 52/522
4,866,896 A * 9/1989 Shreiner ..... E04F 13/0736 52/235
4,918,898 A * 4/1990 McLeod, Jr. ..... E04F 13/12 52/478
4,961,295 A * 10/1990 Kosch, Sr. ..... A47F 5/0846 211/94.02
5,138,812 A * 8/1992 Palmersten ..... E04B 1/6129 52/309.9
5,285,609 A * 2/1994 Goad ..... E04C 2/292 52/588.1
5,293,728 A * 3/1994 Christopher ..... F16B 5/0016 52/309.9
5,430,982 A * 7/1995 Bane ..... E06B 9/04 49/464
5,678,369 A * 10/1997 Ishikawa ..... E04B 1/942 52/309.9
5,715,633 A * 2/1998 Raz ..... A47B 21/06 52/220.7
5,737,894 A * 4/1998 Simpson ..... E04C 3/08 52/404.2
5,875,592 A 3/1999 Allman et al.
6,044,609 A * 4/2000 Kim ..... E04F 13/0864 52/551
6,253,511 B1 7/2001 Boyer
6,298,626 B2 * 10/2001 Rudden ..... E04C 2/296 52/309.9
6,338,228 B1 * 1/2002 Chevalier ..... E04B 9/008 52/22
6,627,128 B1 9/2003 Boyer
6,681,539 B2 * 1/2004 Yost ..... E04B 2/8635 52/309.11
6,694,694 B2 2/2004 Zeeff
6,968,659 B2 11/2005 Boyer
7,007,433 B2 3/2006 Boyer
D527,834 S 9/2006 Thimons et al.
D538,948 S 3/2007 Thimons et al.
7,198,159 B2 * 4/2007 Fischer ..... A47F 5/0846 211/189
7,398,624 B2 * 7/2008 Swiszcz ..... E04B 9/001 52/211
7,678,219 B2 3/2010 Thompson et al.
7,748,181 B1 7/2010 Guinn
7,895,807 B2 3/2011 Thompson et al.
8,136,323 B2 * 3/2012 King ..... E04F 13/0876 52/524
8,205,395 B2 * 6/2012 Jakiel ..... E04F 13/18 52/36.5
8,210,503 B2 * 7/2012 Garrison ..... E04H 17/16 256/24
8,256,165 B2 * 9/2012 Crego ..... E04D 3/40 52/58
8,261,499 B2 9/2012 Boyer et al.
8,474,202 B2 7/2013 Boyer et al.
8,584,425 B2 * 11/2013 Wagner ..... E04F 13/0837 52/588.1
8,631,620 B2 1/2014 Guinn et al.
8,661,756 B2 3/2014 Boyer et al.
D713,978 S 9/2014 Zombek
8,938,927 B1 * 1/2015 Bragg ..... E04B 2/02 52/483.1
9,027,301 B2 5/2015 Guinn
9,249,571 B1 * 2/2016 White ..... E04B 1/80
9,267,280 B2 * 2/2016 Sawatzky ..... E04B 1/7038
D778,465 S 2/2017 Zombek
9,695,596 B2 * 7/2017 McIntosh ..... E04C 2/38
9,938,725 B2 * 4/2018 Johnson ..... E04F 13/0846
10,100,529 B2 * 10/2018 Marchesi ..... E04F 13/0801
10,590,659 B2 * 3/2020 Santarossa ..... E04F 13/0876
2010/0132295 A1 * 6/2010 Bootier ..... E04F 13/0841 52/520
2014/0224459 A1 * 8/2014 Sasaki ..... E04B 1/7645 165/169

* cited by examiner

ARCHITECTURAL WALL PANEL SYSTEM

BACKGROUND

1. Field of the Invention

The present invention generally relates to building walls and, more specifically, to an architectural wall panel system for covering either an exterior or interior wall of a building.

2. Description of Related Art

Generally, architectural wall panels are used to provide a weather resistant shell about the exterior of the building upon which they are installed. Conventionally, the joints between adjacent wall panels and/or the engagement of the wall panels with the building need to be sealed properly to prevent the ingress of water and other environmental factors into the building. Sealing has been previously done with gaskets and sealants.

More recently, wall panels have been developed that do not require gaskets and sealants. Overlapping and interlocking portions of adjacent panels forms the sealing feature of these types of panels known as rainscreens.

While these types of panels have worked sufficiently for their intended purposes, the overlapping and interlocking aspects of the known wall panels sometimes do not form a sufficiently robust seal and/or do not form a sufficient engagement with one another.

SUMMARY

In satisfying the above need, as well as overcoming the enumerated drawbacks and other limitations of the related art, the present invention provides an architectural wall panel and wall panel system that includes robust sealing and supporting engagements.

Accordingly, in one aspect of the invention, an architectural wall panel is provided that includes a panel body. The panel body includes a generally rectangular face plate having an upper end, a lower end, a front surface and a rear surface, with the front surface facing in a forward direction and the rear surface facing in a rearward direction that is opposite of the forward direction. An upper flange generally extends from the upper end of the face plate in the rearward direction and includes a first projection. The first projection extends laterally relative to the rearward direction and includes a front side and a rear side. A lower flange generally extends from the lower end of the face plate in the rearward direction and terminates in a clip. The clip includes a first leg extending toward the upper flange and a second leg extending away from the upper flange. The first leg of the clip is configured to engage a front side of a first projection of a second architectural wall panel positioned below the architectural wall panel. A second leg of the clip is configured to engage a rear side of the first projection of the second architectural wall panel, whereby the first projection of the second architectural wall panel is clamped between the first and second legs of the clip.

In another aspect, the first leg of the clip is generally planar.

In a further aspect, the first and second legs of the clip are spaced apart from one another.

In an additional aspect, the first and second legs of the clip are connected by a bight.

In yet another aspect, at least a part of the second leg of the clip extends obliquely relative to the upper flange.

In a still further aspect, at least a part of the second leg of the clip extends obliquely relative to the upper flange in the forward direction.

In an additional aspect, the second leg of the clip extends beyond a perimeter of the face plate defined by the lower end.

In still another aspect, the first leg of the clip extends to a position on one side of a perimeter of the face plate defined by the lower end and the second leg of the clip extends to a position on an opposing side of the perimeter of the face plate defined by the lower end.

In yet a further aspect, the first projection of the upper flange is a double walled structure.

In an additional aspect, the panel body is unitarily formed.

According to another aspect of the invention, an architectural wall panel system is provided having a plurality of panel bodies including at least a first panel body and a second panel body; the first panel body including a generally rectangular face plate having an upper end, a lower end, a forward facing front side and a rearward facing rear side, a lower flange generally extending rearward from the lower end and terminating in a clip, the clip including a first leg extending toward the upper flange and a second leg extending away from the upper flange; the second panel body including a generally rectangular face plate having an upper end, a lower end, a forward facing front side and a rearward facing rear side, an upper flange generally extending rearward from the upper end and including a transversely extending first projection, the first projection having a forward facing front side and a rearward facing rear side; the first leg of the clip of the first panel body being configured to engage the front side of the first projection of the second panel body, the second leg of the clip of the first panel body being configured to engage the second side of the first projection of the second panel body; and whereby the first projection of the second panel body is clamped between the first and second legs of the clip of the first panel body.

In another aspect, the first leg of the clip is generally planar.

In a further aspect, the first and second legs of the clip are spaced apart from one another and connected by a bight.

In an additional aspect, at least a part of the second leg of the clip extends obliquely relative to the upper flange.

In still another aspect, at least a part of the second leg of the clip extends obliquely relative to the upper flange in the forward direction.

In a further aspect, the second leg of the clip extends beyond a perimeter of the face plate defined by the lower end of the first panel body.

In yet an additional aspect, the first leg of the clip extends to a position on one side of a perimeter of the face plate defined by the lower end of the first panel body and the second leg of the clip extends to a position on an opposing side of the perimeter defined by the lower end of the first panel body.

In another aspect, the first projection of the upper flange is a double walled structure.

In still a further aspect, each of the plurality of panel bodies is unitarily formed.

In yet an additional aspect, each of the panel bodies is identically formed.

In another aspect of the invention, an architectural wall panel system is providing having a plurality of unitary panel bodies including at least a first panel body and a second panel body. The first panel body includes a generally rectangular face plate having an upper end, a lower end, a forward facing front side and a rearward facing rear side. A lower flange extends generally extending from the lower end and includes a clip spaced apart from a terminal tail end of the lower flange. The clip including a first leg extending toward the upper flange and a second leg extending away from the upper flange. The second panel body includes a generally rectangular face plate having an upper end, a lower end, a forward facing front side and a rearward facing rear side. An upper flange extends generally rearward from the upper end and includes a transversely extending first projection spaced apart from a terminal portion of the upper flange by a rearwardly extending intermediate portion. The first projection has a forward facing front side and a rearward facing rear side. The first leg of the clip of the first panel body engages the front side of the first projection of the second panel body and forms a first seal. The second leg of the clip of the first panel body engages the rear side of the first projection of the second panel body and forms a second seal. The terminal tail end of the lower flange engages the intermediate portion and forms a third seal. Accordingly, the first projection of the second panel body is clamped between the first and second legs of the clip of the first panel body and provided with the first, second and third seals.

Further objects, features and advantages of this invention will become readily apparent to persons skilled in the art after review of the following description, including the claims, and with reference to the drawings that are appended to and form a part of this specification.

BRIEF DESCRIPTION OF THE DRAWINGS

FIG. 3 is a cross-sectional view of the wall panel system generally taken along line 3-3 in

FIG. 1.

DETAILED DESCRIPTION

Figure 1:
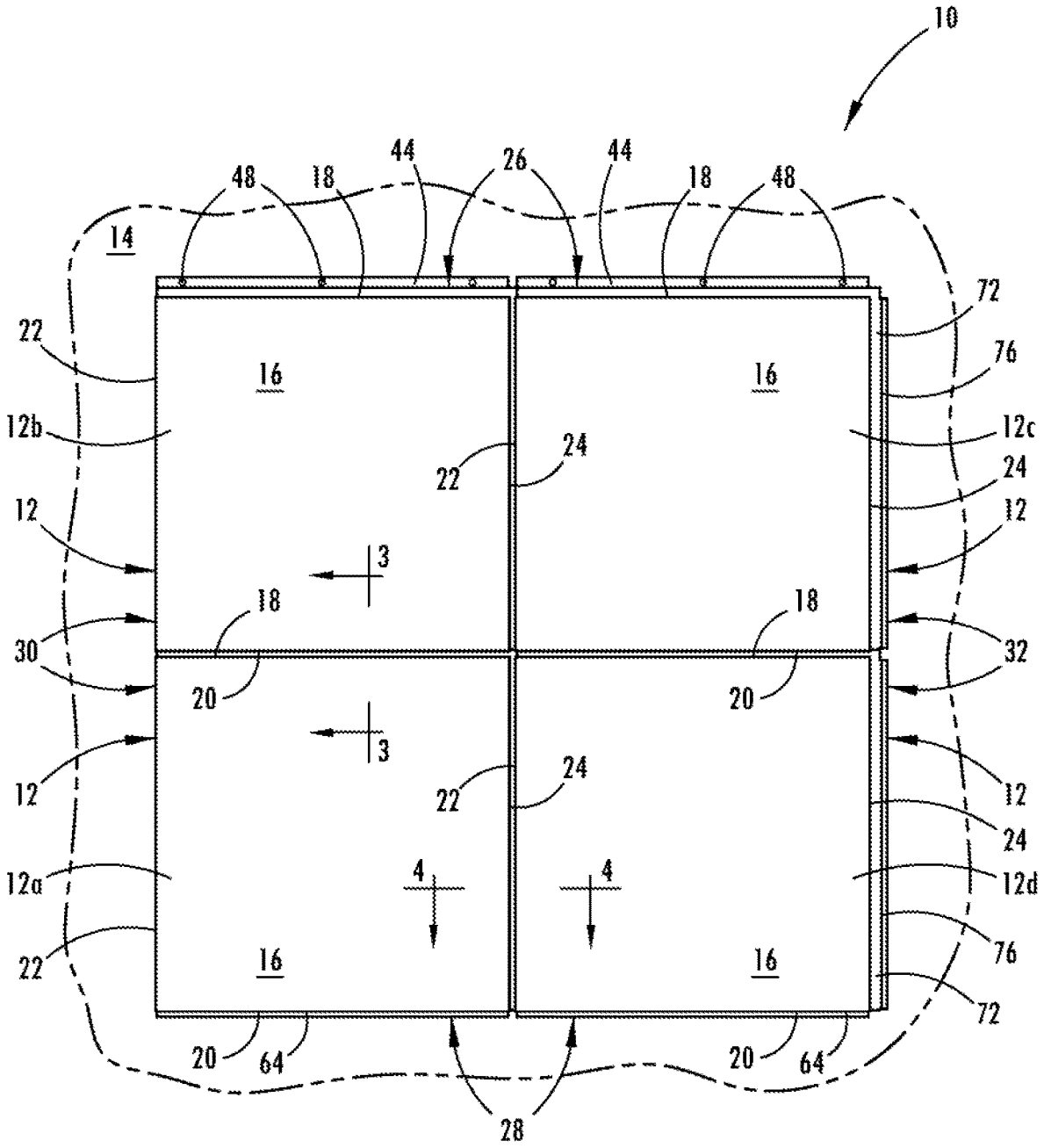
FIG. 1 illustrates a wall to which a wall panel system embodying the principles of the present invention is attached.

As used in the description that follows, directional terms such as "upper" and "lower" are used with reference to the orientation of the elements as presented in FIG. 1. Accordingly, "upper" indicates a direction toward the top of the figure and "lower" indicates a direction toward the bottom of the figure. The terms "left" and "right" are similarly interpreted. The terms "inward" or "inner" and "outward" or "outer" indicate a direction that is generally toward or away from a central axis of the referred to part, whether or not such an axis is designated in the figures. An axial surface is therefore one that faces in the axial direction. In other words, an axial surface faces in a direction along the central axis. A radial surface therefore faces radially, generally away from or toward the central axis. It will be understood, however, that in actual implementation, the directional references used herein may not necessarily correspond with the installation and orientation of the corresponding components or device.

Figure 2:
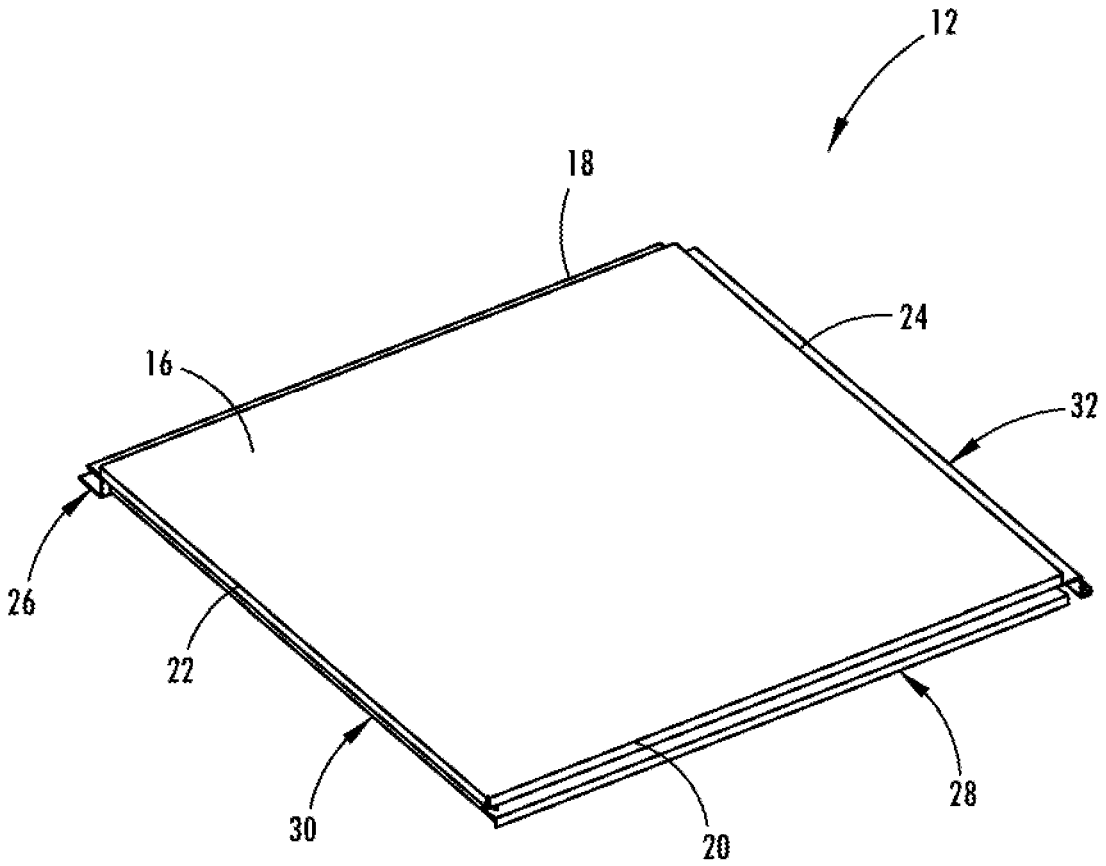
FIG. 2 is a perspective view of an individual wall panel in accordance with the principles of the present invention.

Referring now to the drawings, an architectural wall panel system embodying the principles of the present invention is generally illustrated in FIG. 1 and designated at 10. The wall panel system 10 includes a plurality of individual wall panels 12, each of which is identical to one another. As illustrated, four wall panels 12*a*, 12*b*, 12*c*, 12*d* are mounted to a wall 14, such as the exterior wall, of a building so as to protect the building from environmental factors, including rain, and enhance the aesthetics of the building. While only four individual panels 12*a*-12*d* are illustrated, the wall panel system 10 may include as many individual panels 12 as are necessary to cover the building, the wall of the building or an intended portion of the wall of the building. Thus, the number of individual wall panels 12 used in a given installation may vary greatly and is only limited by the size of the installation. A single individual wall panel 12 is generally illustrated in FIG. 2.

Each wall panel 12 is preferably made from a single, unitary sheet of metal material. Preferred metal materials include, but are not limited to, aluminum, zinc, copper and stainless steel. The various flanges of the panel 12 are formed by bending corresponding perimeter portions of the sheet into the above described shapes. Accordingly, the term unitary, as used herein, is intended to mean a one-piece construction and is distinguished from the term integral, which may include a multi-piece construction.

As further explained below, each of the individual wall panels 12 is configured so as to be able to engage with an adjacent wall panel 12 about its perimeter. Thus, one individual wall panel 12 generally engages with adjacent wall panels 12 that are respectively located above, below, right and left of the given wall panel 12.

To enable this engagement, each wall panel 12 is formed as a body having a generally rectangular face plate 16 having an upper end 18, a lower end 20, a left end 22 and a right end 24. A top or upper flange 26 extends from the upper end 18 of the face plate 16 and has a length that is generally coextensive with the length of the upper end 18. Similarly, a bottom or lower flange 28 extends from the lower end 20 of the face plate 16, a left lateral flange 30 extends from the left end 22 of the face plate 16, and a right lateral flange 32 extends from the right end 24 of the face plate 16. The lower flange 28 of one wall panel 12 is configured to engage the upper flange 26 of a second wall panel 12 positioned below the one wall panel 12. Similarly, the upper flange 26 of the one wall panel 12 is configured to engage the lower flange 28 of a third wall panel 12 positioned above the one wall panel 12, the left lateral flange 30 of the one wall panel 12 is configured to engage the right lateral flange 32 of a fourth wall panel 12 positioned to the left of the one wall panel 12, and the right lateral flange 32 of the one wall panel 12 is configured to engage the left lateral flange 30 of a fifth wall panel 12 positioned to the right of the one wall panel 12.

In FIG. 1, each wall panel 12 is illustrated as being engaged with only two other wall panels 12. It is noted, however, that each of the above mentioned engagements of the flanges is represented in that figure.

Figure 3:
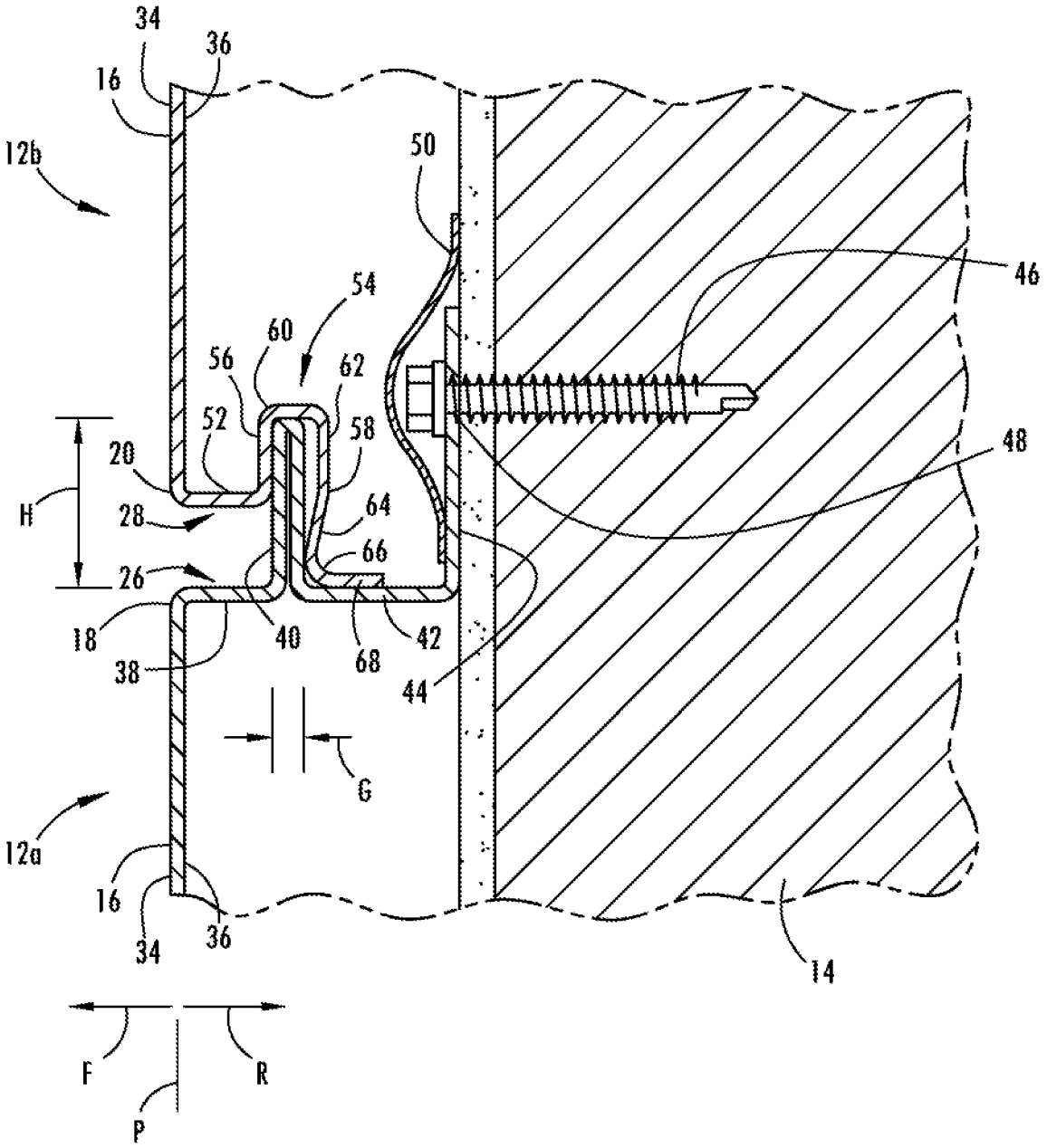

Referring now to FIG. 3, as seen therein, the face plates 16 of the wall panels 12 have a front surface 34 facing in a forward direction (F) and which is visible when the wall panels 12 are installed to the wall 14 of the building. The face plates 16 of the wall panels 12 also have a rear side 36 facing in a rearward direction (R) and which is not visible when the wall panels 12 are installed to the wall 14 of the building. These directional references are used herein to describe the shapes of the various flanges 26, 28, 30, 32 extending from the face plate 16. As will be appreciated by those skilled in the art to which the present invention relates, the description of a particular flange in connection with one of the wall panels 12 is equally applicable to a corresponding flange of another wall panel 12

Continuing with reference to FIG. 3, illustrated therein is a cross-section of a portion of the wall panel system 10 seen attached to the wall 14 in FIG. 1. The cross-section specifically shows the engagement of the upper flange 26 of wall panel 12*a* with the lower flange 28 of wall panel 12*b*.

The upper flange 26 extends generally in the rearward direction (R) from the upper end 18 of the face plate 16 and its initial portion 38 is generally perpendicular to a plane (P) defined by the face plate 16. Partway along the rearward extension of the upper flange 26, the upper flange 26 is formed with an engagement rib 40 that projects laterally relative to the initial portion 38 and outward of a perimeter of the face plate 26 defined by the upper end 18. Thus, the engagement rib 40 forms a projection that is visible when viewing the front surface 34 of the wall panel 12. The engagement rib 40 is preferably formed as a double walled structure wherein the sheet material forming the upper flange 26 is folded back upon itself to thereby provide the engagement rib 40 with substantial rigidity.

Subsequent to the engagement rib 40, the upper flange 26 continues its rearward extension by way of an intermediate portion 42 that corresponds with the initial portion 38. At the terminal end of its rearward extension, the upper flange 26 is provided with an attachment rib 44. The attachment rim 44 extends from the intermediate portion 42 in the same direction as the engagement rib 40 and is parallel thereto. The attachment rib 44 forms a flange by which the wall panel 12 may be attached to the wall 14. Preferably, the wall panel 12 is attached to wall 14 by a fastener 46, such as wood screw, inserted through an aperture 48 into predrilled holes in the various substrates forming the wall 14. Self-sealing tape 50 may be secured to the wall 14 and extended over the attachment rib 44 and fastener 46 to form an additional environmental barrier with respect to the hole in the wall 14.

The lower flange 28, as also seen in FIG. 3, extends generally in the rearward direction (R) from the lower end 18 of the face plate 16 of wall panel 12*b*. The initial portion 38 of the lower flange 28 is also generally perpendicular to the plane (P) defined by the face plate 16. Partway along its rearward extension, the lower flange 28 is formed with a unitary clip 54.

The clip 54 includes a first leg 56 extending generally perpendicularly to the initial portion 52 of the lower flange 28 and in a direction toward the upper flange 26 of the wall panel 12. Accordingly, the first leg 56 is generally parallel to the plane (P) defined by the face plate 16 and perpendicular to the forward and rearward directions (F), (R). A second leg 58 of the clip 54 is connected to the first leg 56 by a bight 60 and extends away from the upper flange 26. The second leg 58 includes two distinct portions, a parallel portion 62 and an oblique portion 64.

The parallel portion 62 is spaced apart from, but parallel to, the first leg 56. While shown and described as parallel to the first leg 56, it is optional that this portion 62 be parallel to the first leg 56. The portion 62 may alternatively be curved or rounded. The oblique portion 64 is angled relative first leg 56, generally in the forward direction (F) until transition at a bend 66 to a rearwardly extending tail portion 68, the latter of which is parallel to and offset from the initial portion 52 of the lower flange 28.

The dimensions of the initial portions 38, 58 in the rearward direction (R) are such that when the first leg 56 rests upon and contacts the engagement rib 40, as seen in FIG. 3, the face plates 16 of the wall panels 12*a*, 12*b* are flush with one another. The forward most surface of the oblique portion 64 and/or the bend 66 cooperates with the rearward surface of the first leg 56 to define a gap (G) measured in the rearward direction (R). The gap (G) is preferably dimensioned to be slightly smaller than the width of the engagement rib 40, also as measured in the rearward direction (R). Notably, the parallel portion 62 is spaced from the first leg 56 by a dimension that is greater than the dimension of the gap (G). The lower surface of the tail portion 68 and the lower surface of the bight 60 define a dimension generally corresponding to the height (H) of the engagement rib 40, as measured upward from the initial portion 38 of the upper flange 26. As a result of this dimension, it is seen that the first leg 56 of the clip 54 extends to a position on one side of a perimeter of the face plate 16 defined by the lower end 20 and the second leg 58 of the clip 54 extends to a position on an opposing side or beyond the perimeter of the face plate 16 defined by the lower end 20.

Figure 4:
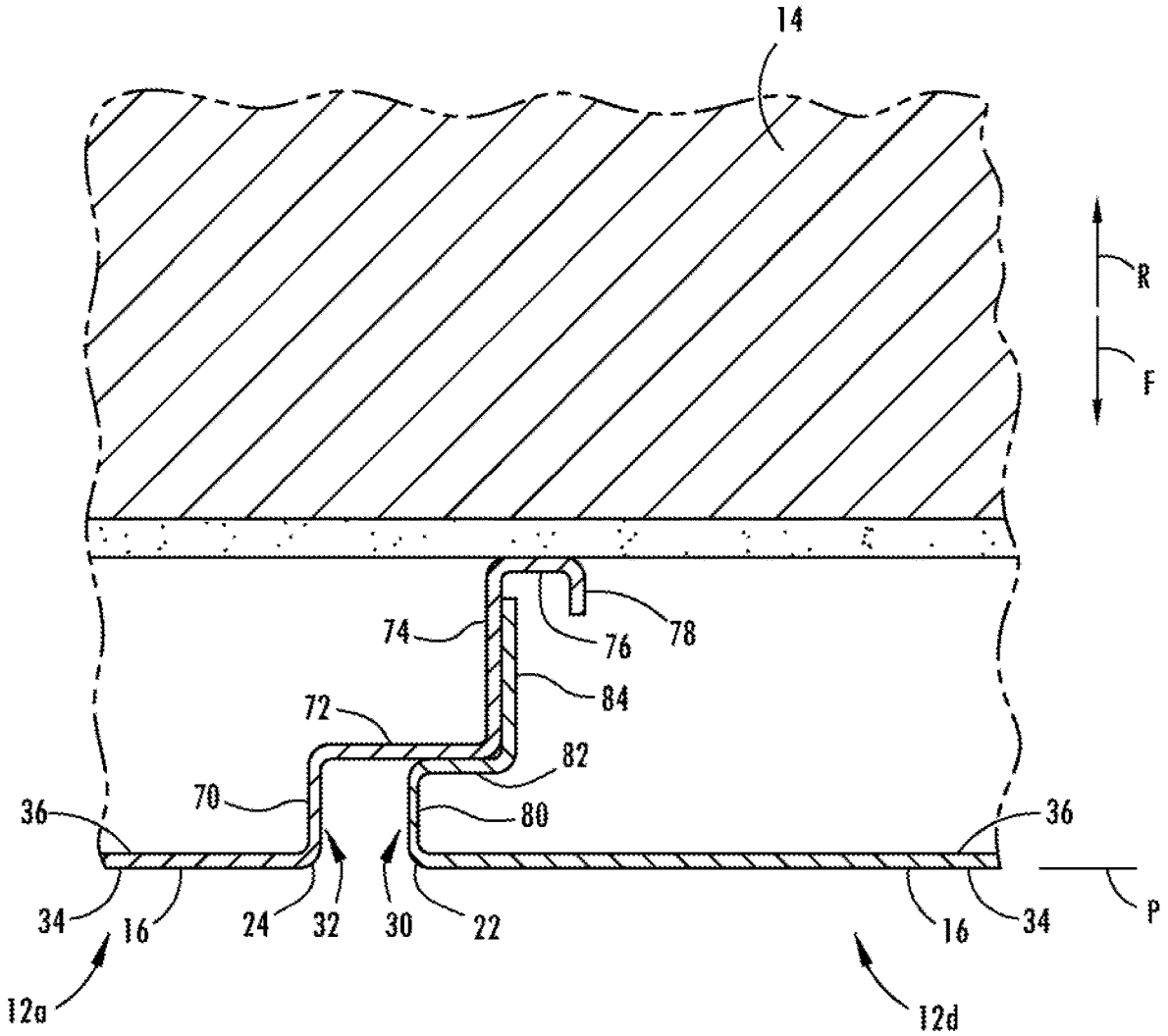
FIG. 4 is a cross-sectional view of the wall panel system generally taken along line 4-4 in FIG. 1.

Seen in FIG. 4, and representative of all of the wall panels 12, are the left and right lateral flanges 30, 32 of wall panels 12*d*, 12*a*.

The right lateral flange 32 extends generally in the rearward direction (R) from the right end 24 of the face plate 16 and its initial portion 70 is generally perpendicular to the plane (P) defined by the face plate 16. Partway along the rearward extension of the right lateral flange 32, the right lateral flange 32 is formed with an outward step 72 that projects generally parallel to the plane (P). Thereafter, the right lateral flange 32 includes an intermediate portion 74 extending again in rearward direction that is parallel to, but offset from, the initial portion 70. After the intermediate portion 74, the right lateral flange 32 is formed with an outward foot 76 that also projects generally parallel to the plane (P) and which terminates in a reversely bent tail portion 78.

The left lateral flange 30 corresponds in part to the right lateral flange 32 and similarly extends generally in the rearward direction (R) from the left end 22 of the face plate 16. Its initial portion 80 is generally perpendicular to the plane (P) defined by the face plate 16. Partway along the rearward extension of the left lateral flange 30, the left lateral flange 30 is formed with an outward step 82 that projects generally parallel to the plane (P). Next, the left lateral flange 30 includes a terminal portion 84 extending, again, in rearward direction that is parallel to, but offset from, the initial portion 80. Similarly to the upper and lower flanges 26, 28, the dimensions, in the rearward direction (R), of the initial portions 70, 80 of the left and right lateral flanges 30, 30 are such that when outward step 82 rests upon outward step 72, as seen in FIG. 4, the face plates 16 of the wall panels 12*a*, 12*d* are flush with one another.

The wall panel system 10 is install on the wall 14 by starting with the bottom most row of wall panels 12. The left most wall panel 12 of the row is generally installed first. As seen in FIG. 1, this would be wall panel 12*a*. The wall panel 12*a* would be mounted on or against a bottom starter strip (not shown) as well as a left trim strip (also not shown). Once properly positioned against the wall 14, the wall panel 12*a* is secured to a structural portion of the wall 14 by inserting the fasteners 46 through the apertures 48 in the attachment rib 44.

Next, the wall panel 12*d* to the right of the installed wall panel 12*a* is installed by positioning the left lateral flange 30 of the to-be installed wall panel 12*d* on and against the right lateral flange 32 of the installed wall panel 12*a*. Because of the shape and dimensions of the left and right lateral flanges 30, 32, the to-be installed wall panel 12*d* is properly spaced to the right of the installed wall panel 12*a*. The to-be install wall panel 12*d* only needs to be properly positioned vertically relative to the previously mentioned starter strip. Once positioned, the to-be installed wall panel 12*d* is similarly secured to the wall 14 by inserting the fasteners 46 through the apertures 48 in the attachment rib 44. This process is then repeated until the installation of the bottom row of wall panels 12 is completed.

The second row of wall panels 12 is then installed, again beginning on the left side of the row. As represented in FIG. 1, the next installed wall panel 12 would be wall panel 12*b*. To install wall panel 12*b*, wall panel 12*b* is first mounted to wall panel 12*a* by inserting the engagement rib 40 of the upper flange 26 into the clip 54, and more specifically into the space between the first and second legs 56, 58. This is initially with the upper end 18 of wall panel 12*b* spaced apart from the wall 14 and the wall panel 12*b* angled relative to the wall 14. Once the engagement rib 40 is inserted into the clip 54, the wall panel 12*b* is rotated toward the wall 14 causing the first and second legs 54, 56 to clamp the engagement rib 40 therebetween. In the clamped position, the rearward surface of the first leg 56 contacts the forward surface of the engagement rib 40 and the forward most surface of the oblique portion 64 and/or the bend 66 contacts the rearward surface of the engagement rib 40. Additionally, the lower surface of the tail portion 68 contacts the upper surface of the intermediate portion 42. Because of the shape and dimensions of the upper and lower flanges 26, 28, the upper wall panel 12*b* is properly spaced relative to the lower wall panel 12*a*. Wall panel 12*b* may then be secured to the wall 14 by inserting the fasteners 46 through the apertures 48 in the attachment rib 44.

The above installation process is then repeated, starting with the wall panel 12*c* to the right of wall panel 12*b* until the second row of wall panels 12 is completed. The third and subsequent rows of wall panels 12 are installed in the same manner.

As seen from the above description, three distinct seals are formed between two adjacent wall panels 12, such as wall panels 12*a*, 12*b*, by the engagement of the upper and lower flanges 26, 28. A first seal is formed by contact and engagement of the rearward surface of the first leg 56 with forward surface of the engagement rib 40. A second seal is formed by contact and engagement of the forward most surface of the oblique portion 64 and/or the bend 66 with the rearward surface of the engagement rib 40. A third seal is formed by contact and engagement of the lower surface of the tail portion 68 and the upper surface of the intermediate portion 42. This triple redundancy in the sealing between the upper and lower flanges 26, 28 provides the wall panel system 10 with enhanced resistance to encroachment by water and other environmental factors.

The above description is meant to be illustrative of at least one preferred implementation incorporating the principles of the invention. One skilled in the art will really appreciate that the invention is susceptible to modification, variation and change without departing from the true spirit and fair scope of the invention, as defined in the claims that follow. The terminology used herein is therefore intended to be understood in the nature of words of description and not words of limitation.

We claim:

1. An architectural wall panel comprising:

a panel body, the panel body including a generally rectangular face plate having an upper end, a lower end, a front surface and a rear surface, the front surface facing in a forward direction and the rear surface facing in a rearward direction, the rearward direction being opposite of the forward direction, an upper flange generally extending from the upper end of the face plate in the rearward direction and including a first projection, the first projection extending laterally relative to the rearward direction and including a front side and a rear side, the front and rear sides extending parallel to one another and defining a second width, a lower flange generally extending from the lower end of the face plate in the rearward direction and terminating in a clip, the clip including a first leg extending toward the upper flange and a second leg extending away from the upper flange, the first leg of the clip extending in a first plane parallel to the front side and being configured to engage a front side of a first projection of a second architectural wall panel positioned below the architectural wall panel, and the second leg of the clip being configured to engage a rear side of the first projection of the second architectural wall panel, the first and second legs of the clip being spaced apart from one another and having a minimum gap defined between the first plane and the second leg as a first width, the second width being greater than the first width whereby the first and second legs of the clip exert a pinching force on the first and second sides of the first projection when said first projection is located between the first and second legs.

2. The architectural wall panel according to claim 1, wherein at least a part of the second leg of the clip extends obliquely relative to the upper flange.

3. The architectural wall panel according to claim 1, wherein at least a part of the second leg of the clip extends obliquely relative to the upper flange in the forward direction.

4. The architectural wall panel according to claim 1, wherein the second leg of the clip extends beyond a perimeter of the face plate defined by the lower end.

5. The architectural wall panel according to claim 1, wherein the first leg of the clip extends to a position on one side of a perimeter of the face plate defined by the lower end and the second leg of the clip extends to a position on an opposing side of the perimeter of the face plate defined by the lower end.

6. The architectural wall panel according to claim 1, wherein the first projection of the upper flange is a double walled structure.

7. The architectural wall panel according to claim 1, wherein the panel body is unitarily formed.

8. The architectural wall panel according to claim 1, wherein the first and second effective widths are defined where the clip is engaged with the projection.

9. An architectural wall panel system comprising:

a plurality of unitary panel bodies including at least a first panel body and a second panel body;

the first panel body including a generally rectangular face plate having an upper end, a lower end, a forward facing front side and a rearward facing rear side, a lower flange generally extending rearward from the lower end and terminating in a clip;

the second panel body including a generally rectangular face plate having an upper end, a lower end, a forward facing front side and a rearward facing rear side, an upper flange generally extending rearward from the upper end and including a transversely extending first projection, the first projection having a forward facing front side extending parallel to and a rearward facing rear side and defining a second width therebetween;

the clip of the first panel body including a first leg extending toward the upper flange and a second leg extending away from the upper flange, the first leg of the clip of the first panel body extending in a first plane parallel to the front side and being configured to engage the front side of the first projection of the second panel body, the second leg of the clip of the first panel body being configured to engage the second side of the first projection of the second panel body, the first and second legs of the clip being spaced apart from one another and having a minimum gap defined between the first plane and the second leg as a first effective width, the second width being greater than the first effective width; and whereby the first and second legs of the clip of the first panel body exert a pinching force on the first projection of the second panel body when said first projection is located between the first and second legs.

10. The architectural wall panel system according to claim 9, wherein at least a part of the second leg of the clip extends obliquely relative to the upper flange.

11. The architectural wall panel system according to claim 9, wherein at least a part of the second leg of the clip extends obliquely relative to the upper flange in the forward direction.

12. The architectural wall panel system according to claim 9, wherein the second leg of the clip extends beyond a perimeter of the face plate defined by the lower end of the first panel body.

13. The architectural wall panel system according to claim 9, wherein the first leg of the clip extends to a position on one side of a perimeter of the face plate defined by the lower end of the first panel body and the second leg of the clip extends to a position on an opposing side of the perimeter defined by the lower end of the first panel body.

14. The architectural wall panel system according to claim 9, wherein the first projection of the upper flange is a double walled structure.

15. The architectural wall panel system according to claim 9, wherein the plurality of panel bodies are identical to one another.

16. The architectural wall panel system according to claim 9, wherein the first and second effective widths are defined where the clip is engaged with the projection.

17. An architectural wall panel system comprising:

a plurality of unitary panel bodies including at least a first panel body and a second panel body;

the first panel body including a generally rectangular face plate having an upper end, a lower end, a forward facing front side extending parallel to a rearward facing rear side, a lower flange generally extending rearward from the lower end and including a clip spaced apart from a terminal tail end of the lower flange, the clip including a first leg extending toward the upper flange in a first plane parallel to a second leg extending away from the upper flange;

the second panel body including a generally rectangular face plate having an upper end, a lower end, a forward facing front side and a rearward facing rear side, an upper flange generally extending rearward from the upper end and including a transversely extending first projection spaced apart from a terminal portion of the upper flange by a rearwardly extending intermediate portion, the first projection having a forward facing front side extending parallel to a rearward facing rear side and defining a second width therebetween;

the first leg of the clip of the first panel body engaging the front side of the first projection of the second panel body and forming a first seal, the second leg of the clip of the first panel body engaging the rear side of the first projection of the second panel body and forming a second seal, the terminal tail end of the lower flange engaging the intermediate portion and forming a third seal, the first and second legs of the clip being spaced apart from one another and having a minimum gap defined between the first plane and the second leg as a first effective width, the second width being greater than the first effective width; and whereby the first and second legs of the clip of the first panel body exert a pinching force on the first projection of the second panel body when said first projection is located between the first and second legs and provides the first, second and third seals.

18. The architectural wall panel system according to claim 17, wherein the first and second effective widths are defined where the clip is engaged with the projection.

* * * * *